US005609173A

United States Patent [19]

Hollrock

[11] Patent Number: 5,609,173

[45] Date of Patent: Mar. 11, 1997

[54] DEVICE FOR PREWASHING AND SORTING GOLF BALLS

[75] Inventor: J. Richard Hollrock, South Deerfield, Mass.

[73] Assignee: Hollrock Engineering, Inc., Hadley, Mass.

[21] Appl. No.: 488,506

[22] Filed: Jun. 9, 1995

[51] Int. Cl.[6] ..... B08B 3/04

[52] U.S. Cl. ..... 134/83; 134/104.3; 134/104.4; 134/133; 134/191; 134/195; 209/677

[58] Field of Search ..... 134/61, 83, 104.3, 134/104.4, 133, 191, 195; 15/21.2, 3.11, 3.15; 209/675, 677

[56] References Cited

U.S. PATENT DOCUMENTS

| | | | |
|---|---|---|---|
| 3,038,186 | 6/1962 | Davy | 15/21.2 |
| 3,125,775 | 3/1964 | Clifton | 15/21.2 X |
| 3,820,183 | 6/1974 | Gustafson et al. | 15/21.2 |
| 5,077,854 | 1/1992 | Moons | 134/133 X |
| 5,139,577 | 8/1992 | Brock | 134/133 X |
| 5,353,822 | 10/1994 | Gutterman et al. | 134/133 X |

FOREIGN PATENT DOCUMENTS

| | | | |
|---|---|---|---|
| 2231804 | 11/1990 | United Kingdom | 15/21.2 |

*Primary Examiner*—Philip R. Coe
*Attorney, Agent, or Firm*—McCormick, Paulding & Huber

[57] ABSTRACT

A prewasher for sorting and soaking golf balls prior to entry into a ball washer has a tub for receiving the balls, a standpipe in the tub through which a stream of water moves the balls up out of the tub to deposit them in a track that carries only round balls to the ball washer. Broken balls and/or stones drop through openings in the track and are not delivered to the ball washer.

4 Claims, 1 Drawing Sheet

DEVICE FOR PREWASHING AND SORTING GOLF BALLS

BACKGROUND OF THE INVENTION

1. Field of the Invention

The present invention relates to golf ball washing devices and more specifically to a device for prewashing and sorting golf balls gathered from a driving range environment for delivery of round balls suitable for reuse to a conventional ball washer.

2. Description of the Prior Art

Golf ball washers generally are well known in the prior art, and Applicant's prior U.S. Pat. No. 4,805,251 is an example of a conventional ball washer of the type suitable for accepting balls delivered to it by a device constructed in accordance with the present invention.

In a typical golf ball driving range environment broken golf balls and small stones or other foreign objects can be picked-up by the equipment used to retrieve golf balls after they have been used by a customer at a typical driving range. While golf balls washers are currently available for washing golf balls prior to reuse, the broken balls and small stones gathered by the golf ball pickup devices can create problems in a conventional ball washer. Further, it is a waste of energy and time to handle such non-round objects in a conventional ball washer.

There is a need therefore to provide a device for presorting and prewashing golf balls prior to delivery of only round golf balls to a conventional ball washer.

SUMMARY OF THE INVENTION

It is a general purpose and object of the present invention to provide a device for prewashing and sorting golf balls prior to delivery of the golf balls to a conventional ball washer.

In its presently preferred form the device of the present invention includes a fluid filled tub for receiving the articles to be prewashed and sorted. Means is provided for circulating a fluid such as water and a suitable detergent through the tub, and more particularly through a standpipe through which the fluid and those balls provided in a lower region of the tub are moved upwardly and out of the fluid filled tub through an exit end of the standpipe. At the exit end of the standpipe, which may comprise an elbow at the top of the standpipe, track means is provided for receiving the balls as they exit the standpipe. The track is preferably in the form of parallel rails defining at least one and preferably two paths which induce rotation of the round golf balls and define opening means through which defective balls and/or other foreign objects such as small stones drop downwardly onto a reject chute or shelf. As a result only the prewashed round balls are provided to the ball washer.

BRIEF DESCRIPTION OF THE DRAWINGS

A more complete understanding of the invention and many of its attendant advantages will be readily appreciated as the same become better understood by reference to the following detailed description when considered in conjunction with the accompanying drawings wherein.

DESCRIPTION OF THE PREFERRED EMBODIMENT

Figure 1:
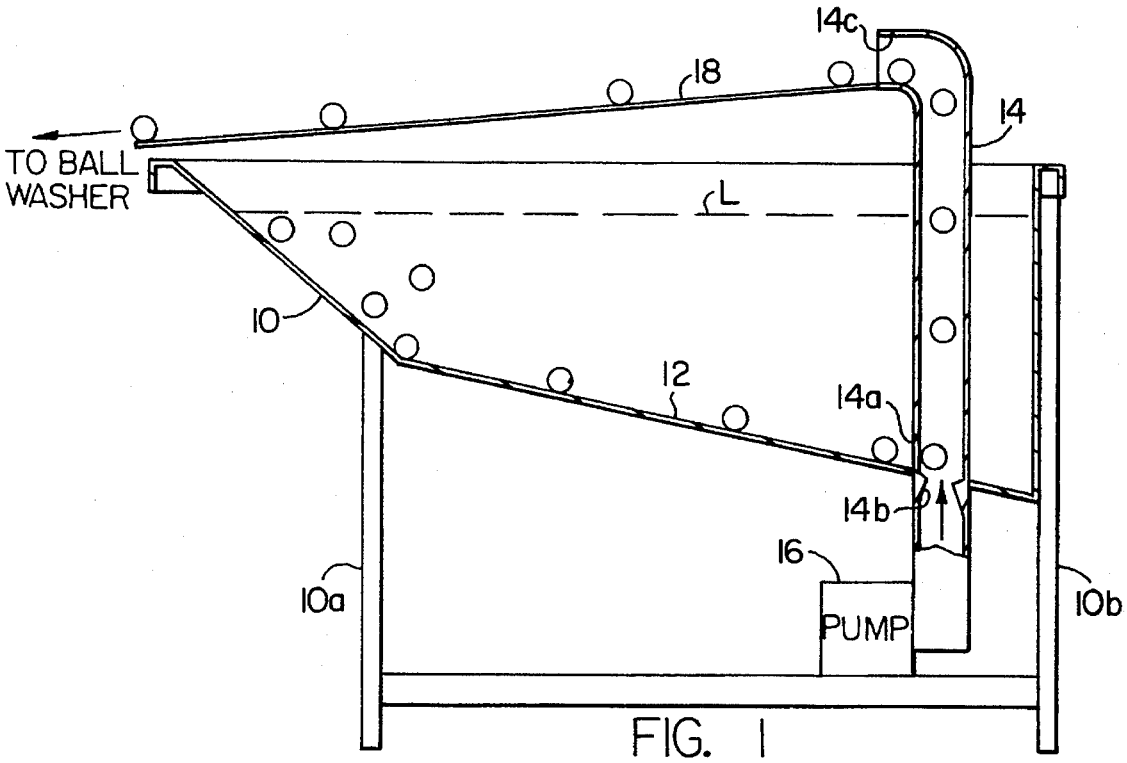
FIG. 1 is a schematic view showing in cutaway fashion the essential elements of the present invention.
Figure 2:
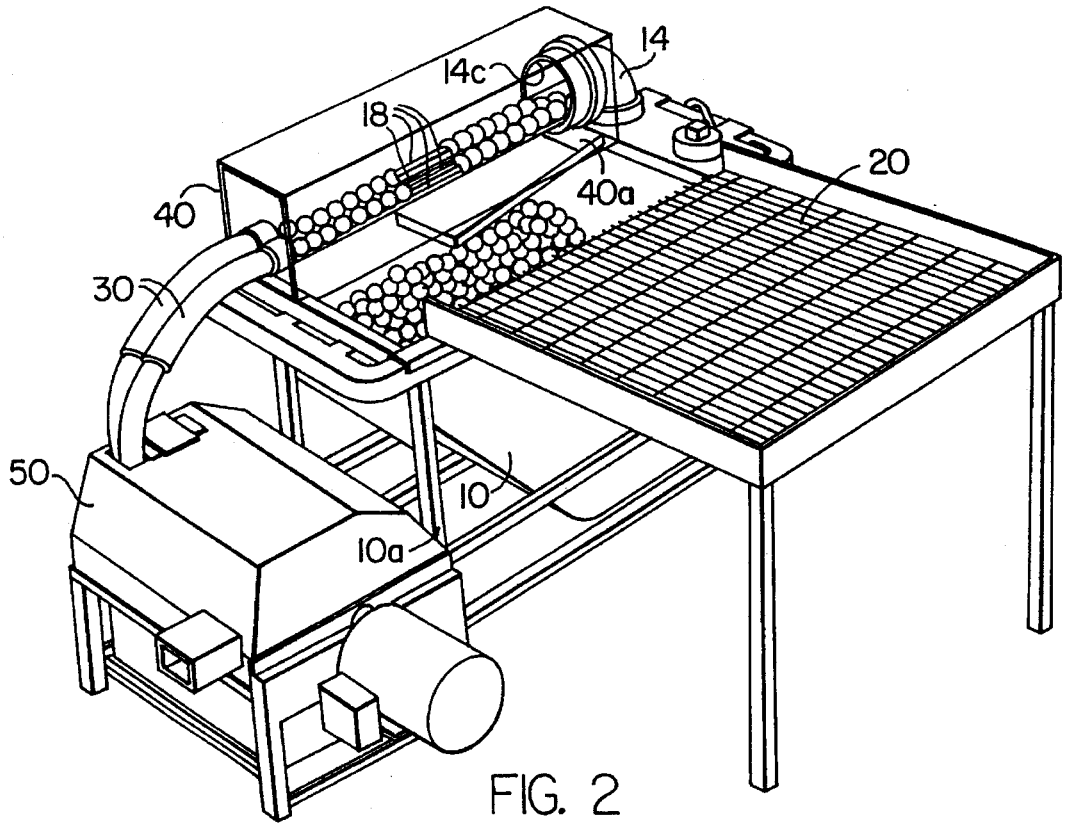
FIG. 2 is a perspective view of a device constructed in accordance with the present invention connected to a conventional ball washer of the type referred to previously.

Referring now to FIG. 1 there is shown a device for prewashing and sorting articles such as golf balls in accordance with the present invention. A fluid filled tub 10 is supported on legs 10*a* and 10*b* so that a level of water, indicated generally at L can be provided inside the tub. The articles gathered by a conventional golf ball retrieving device, of the type commonly used at golf driving ranges, are dumped into the upwardly open tub 10. A suitable grate 20 may be provided for this purpose as shown in FIG. 2 to receive the articles to be prewashed and sorted. The tub 10 is provided with an inclined shelf 12 along which the balls roll downhill toward an inlet 14*a* of a standpipe 14. The lower end of standpipe 14 communicating with a fluid pump as indicated generally at 16. The pump 16 is adapted to circulate the water in the tub 10 by moving the water upwardly in the standpipe 14 through a nozzle 14*b* adjacent the shelf 12 such that the balls are conveyed upwardly in the standpipe 14 towards its exit end 14*c*. The exit end 14*c* of standpipe 14 preferably comprises a right angle or elbow so the balls are discharged horizontally.

At the exit end 14*c* of the standpipe 14 parallel rails 18 are provided to define a track for the round balls in order to convey the round balls by gravity toward a conventional ball washer as shown in FIG. 2. For a more complete illustration of a preferred ball washer reference is made to U.S. Pat. No. 4,805,251. Means is provided for conveying the round balls from the downstream end of the rails 18 into the ball washer 50. Preferably said means comprises flexible conduit or tubing as shown at 30. Applicant's prior U.S. Pat. No. 4,805,251 provides a more complete description of the internal operation of a preferred form of conventional ball washer 50 with which the present sorting device is especially adapted for use, and is incorporated by reference in this disclosure.

Referring now to FIG. 2 in greater detail, the device of the present invention can be seen to include side-by-side parallel tracks or rails 18,18 for handling the golf balls in parallel paths as they move into the inlet of the conventional ball washer 50. It will also be apparent that a reject shelf or chute 40 is provided below the path defined by the rails 18 so as to convey broken golf balls and/or stones or other foreign objects and material away from the path of the balls so that only round balls enter the conventional ball washer. The fluid flowing from the outlet or exit end of the standpipe is nevertheless returned to the tub by reason of this reject shelf or chute 40 having a portion 40*a* so formed as to redirect the water into the tub for this purpose.

Many modifications and variations of the present disclosure will become apparent in light of the above teachings. For example, the water circulated by the pump 16 can be filtered and/or can be continuously replaced with a source of fresh water if desired, with the dirty water being dumped from the tub into a suitable drain provided for this purpose. It will also be apparent that a suitable detergent or ball washing medium might also be provided in the tub 10 which is nevertheless kept at a predetermined water level L in the tub. The preferred fluid is an aqueous solution of appropriate specific gravity for allowing the golf balls to drop downwardly onto the shelf 12 provided for this purpose in an inclined orientation so as to convey the balls into the inlet 14*a* of the standpipe 14.

In light of the above, it is therefore understood that within the scope of the appended claims the invention may be practice otherwise than as specifically described.

What is claimed:

1. A device for prewashing and sorting golf balls prior to the delivery of the balls to a conventional ball washer, said device comprising:

a fluid filled tub for receiving the balls to be prewashed and sorted, said tub defining an inclined shelf for conveying the balls toward one side of the tub, fluid circulating means including a standpipe at said one side of said tub, through which standpipe fluid and balls are moved upwardly and out of said fluid filled tub through an exit end of said standpipe, said standpipe having a ball inlet opening for receiving balls conveyed thereto on said inclined shelf at said one side of said tub, said fluid circulating means including a pump provided below said shelf at the lower end of said standpipe provided adjacent the bottom of said tub, whereby said pump provides a stream of fluid flowing upwardly in said standpipe past the ball inlet opening of said standpipe in order to move the balls upwardly in the standpipe toward the exit end of said standpipe, means defining a track for receiving the balls moving out of the standpipe exit end, and said track defining a path for inducing rotation of round golf balls and defining opening means through which non-round golf balls or the like drop away from said track whereby only prewashed round balls are provided at the ball washer.

2. The combination according to claim 1 further characterized by means for returning the flow of fluid exiting from the standpipe to the tub, and means for diverting articles other than round golf balls away from said tub after they enter the opening means.

3. The combination according to claim 1 further characterized by means connecting the end of said track to a conventional ball washer.

4. The combination according to claim 3 wherein said track is defined by generally parallel rails for inducing rotation of the balls moving along said rails from the exit end of said standpipe to said interconnecting means, and defining said opening means therebetween.

* * * * *